United States Patent [19]

Lindenberg et al.

[11] 4,114,649

[45] Sep. 19, 1978

[54] LEAD DOSING VALVE

[75] Inventors: Hans-Georg Lindenberg, Hannover-Stöcken; Joachim Illmann, Stelingen; Hans-Joachim Golz, Hannover, all of Fed. Rep. of Germany

[73] Assignee: Varta Batterie Aktiengesellschaft, Fed. Rep. of Germany

[21] Appl. No.: 699,674

[22] Filed: Jun. 25, 1976

[30] Foreign Application Priority Data

Jul. 5, 1975 [DE] Fed. Rep. of Germany ..... 2530102

[51] Int. Cl.[2] ..... F16K 11/083

[52] U.S. Cl. ..... 137/625.19; 137/625.30; 137/625.32; 137/245.5; 222/548

[58] Field of Search ..... 137/625.19, 625.30, 137/625.32, 245.5; 222/548, 553, 554

[56] References Cited

U.S. PATENT DOCUMENTS

| | | | |
|---|---|---|---|
| Re. 27,419 | 7/1972 | Nadrich et al. | 251/144 |
| 117,853 | 8/1871 | Allen | 137/625.32 |
| 232,724 | 9/1880 | Jenkins | 137/245.5 |
| 253,405 | 2/1882 | Maxfield | 137/625.19 |
| 919,508 | 4/1909 | Williams | 137/625.32 |
| 1,624,168 | 4/1927 | Gschwind | 137/245.5 |
| 1,725,689 | 8/1929 | Witt | 222/553 |
| 1,956,101 | 4/1934 | Lenoir | 137/625.5 |
| 2,642,254 | 6/1953 | Armstrong | 137/625.3 |

FOREIGN PATENT DOCUMENTS

| | | | |
|---|---|---|---|
| 3,501 of | 1880 | United Kingdom | 137/625.32 |

*Primary Examiner*—William R. Cline
*Assistant Examiner*—H. Jay Spiegel
*Attorney, Agent, or Firm*—Weiser, Stapler & Spivak

[57] ABSTRACT

A valve body has outlet ducts to be positioned below the surface of the molten lead, and a head rotatable with respect to the body. The head has recesses which terminate in slots that can be aligned with the outlet ducts to open the valve. These slots have smaller cross-sections than the ducts. The body also has open ended passages which align with the outlet ducts when the valve is closed.

9 Claims, 6 Drawing Figures

FIG. 1
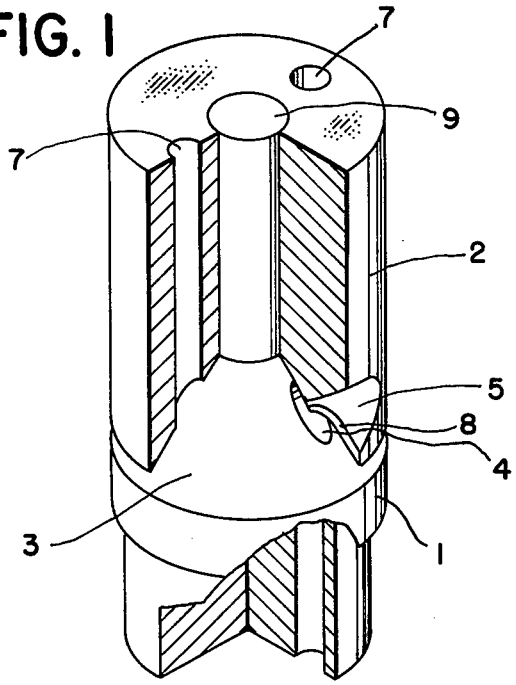
FIG. 2
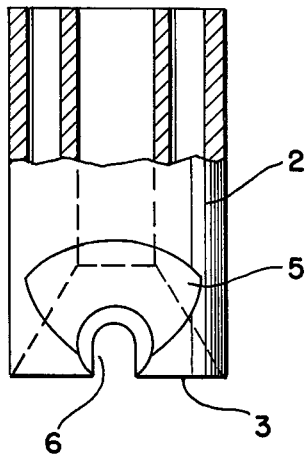
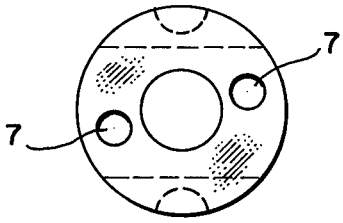
FIG. 4
FIG. 3
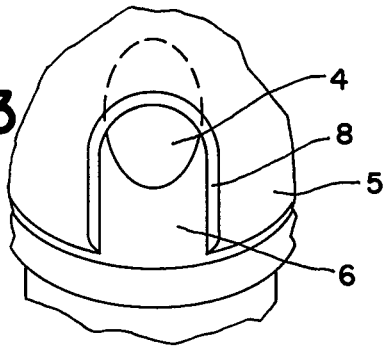
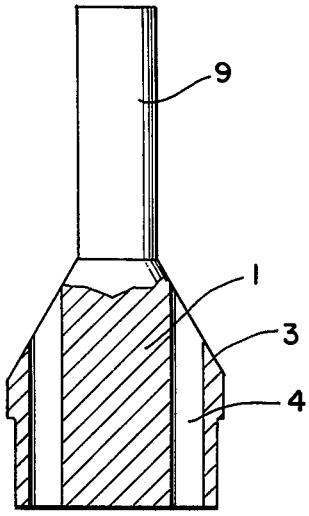
FIG. 5
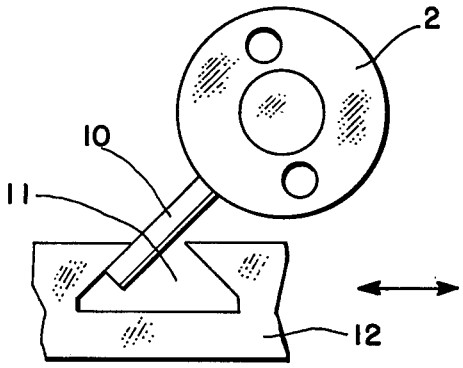
FIG. 6

LEAD DOSING VALVE

This invention relates to a valve for supplying precise dosages of liquid lead into forms. It is characterized by a valve body with outlet ducts which terminate at the working face of the valve body below the lead level in the storage container, which may be closed by means of a valve head provided with recesses.

In many fields of technology, valves are needed to meter quantities of liquid. This need arises, for example, in the casting of pole bridges and cell connectors for storage batteries, in which a predetermined quantity of liquid lead must be recurrently introduced into a form. Such a process is described, for example, in U.S. Pat. Nos. 3,663,305 and 3,774,112, corresponding respectively to German Patent Nos. 1,804,800 and 2,022,163.

Such arrangements frequently utilize valves having valve gates which permit a predetermined quantity of material to flow through in a predetermined interval. However, such arrangements are complicated to control. Moreover, due to working with liquid lead, they are subject to powerful erosion of the members which slide relative to each other, so that accurate dosage by means of this valve becomes impossible after a short time. In particular, after a brief period of usage, such a valve becomes leaky and this leads to after-dripping which interferes with production. When liquid lead is used, there also continuously forms an oxide which deposits on the walls and quickly creates accumulations of dirt and hard encrustations. As a result, precise dosing presents great difficulty.

A rotating metering valve, which works on the principle of a dosage chamber, is disclosed, for example, in German Offenlegungsschrift No. 1,902,489. It permits the filling of a kidney-shaped dosage chamber with liquid lead without great difficulty.

On the other hand, the emptying of the dosage chamber presents difficulty because there is no static pressure. The more the dosage chamber is emptied, the more the outlet velocity diminishes, until the remainder only drips out. When used for liquid lead, residues and particles adhering to the dosage chamber walls can always be expected. As a result, the dosage chamber volume diminishes after a while. In partly or wholly automated production lines, short operating cycles and high repetitive accuracy are desired; these requirements cannot be met by this known type of valve.

Other valve types function in accordance with the Weir principle. In these, lead oxide portions become mixed in with the dosage quantity and the weight and volume variations are also quite large.

Still another valve arrangement for introducing liquid metal is disclosed in U.S. Reissue Patent Re. No. 27,419. It shows a valve body provided with an outlet duct and positioned in the bottom of the container holding the metal melt. A rotatable valve head is positioned on top of it, having a recess which frees the outlet duct when the valve head is turned into a predetermined position.

In the manufacture of storage batteries, i.e., casting of pole bridges and/or cell connectors of lead, it is necessary to use a valve which has high reliability and repeatability. In so doing, a significant problem is posed by the rapid oxide formation in the lead. This causes in known arrangements rapid formation of deposits on the outlet duct apertures and also encrustation of the valve arrangement. The valve must then be removed, during which process the metal bath cools, so that an automatically functioning machine such as disclosed in abovementioned U.S. Pat. No. 3,744,112 is put out of operation for an extended period.

Accordingly, it is an object of the invention to provide an arrangement for precisely dosing liquid lead which is capable of supplying a specific lead quantity out of a lead melt container in oxide-free manner and with high repeat precision.

It is another object to provide such an arrangement which is also capable of delivering relatively small quantities of such liquid lead.

It is still another object to provide such an arrangement which is insensitive to abrasion and encrustation by lead oxides and which can be cleaned during operation so that the need for complicated and time-consuming disassembly is eliminated.

These objects and others which will appear are achieved in accordance with the present invention by providing recesses in the valve head which are so dimensioned that, when the valve is opened, they expose a cross-sectional flow-through aperture above the outlet ducts which is smaller than the cross-section of these outlet ducts themselves.

When the valve is closed, passages in the valve head are aligned with the outlet ducts through which cleaning of these ducts during operation becomes possible. In a preferred embodiment, the liquid lead flows from the valve into the form in free fall, without additional ducting.

For further details reference is made to the discussion which follows in the light of the accompanying drawings wherein:

FIG. 1 shows, in perspective and partly sectioned, a valve embodying the invention;

FIG. 2 shows, partly in cross-section, an elevation of the valve head;

FIG. 3 shows an enlarged view of a portion of the valve head;

FIG. 4 shows the valve head viewed from above;

FIG. 5 shows an elevational cross-section of the valve body; and

FIG. 6 schematically represents apparatus for operating the valve.

The valve embodying the invention consists essentially of two elements, namely a valve body 1 which is firmly attached to the container for the lead melt, and a valve head 2 which may, for example, be rotatably engaged by shaft 9 extending above the valve body. Valve body 1 has a working surface 3 upon which there slides a mating working surface of the valve head 2. It may be desirable to make these working surfaces in a conical shape.

Terminating in a working surface 3, valve body 1 has one or more outlet ducts 4. These may be placed, for example, approximately in the middle of the working surface 3. These outlet ducts 4 are positioned above the forms which are to be filled, into which the lead can then descend by free fall.

Valve head 2 is provided with recesses 5, corresponding in number to outlet ducts 4 in valve body 1 and extending from the outer surface to axial apertures in the working surface of valve head 2 which take the form of slots 6. In addition, valve head 2 has passages 7 which correspond in number and positions to outlet ducts 4 in valve body 1.

The valve is so positioned in the melt container (not shown) that the outlet ducts 4 lie beneath the surface of the lead. The valve is closed when outlet ducts 4 in valve body 1 and passages 7 in valve head 2 are in alignment. By rotating valve head 2, outlet ducts 4 and slots 6 can be brought into alignment and through the cross-sections which are opened as a result, the lead can then flow out into the form. Closing of the valve can be effected either by continuing the rotation or by rotation in the opposite direction. The rotation of the upper portion, i.e., of valve head 2 should take place as quickly as possible since this will determine the precision of the delivered lead quantity. Moreover, care should be taken that during operation of the valve, the static lead level above the outlet duct 4 remains approximately constant. The lead quantity is then determined as to dosage by the open period of the valve.

The flow-through cross-section which is freed by the recess in the open condition of the valve is, in accordance with the invention, smaller than the opening cross-section of the outlet ducts 4 in valve body 1. This has the effect that, when dirt begins to form in the outlet ducts 4 due to lead oxides, there does not arise any impediment to the flow or resulting change in the quantity delivered per unit time. Moreover, through open passages 7 in the valve head, which are aligned with outlet ducts 4 in the closed condition of the valve, and which have the same diameter as the outlet duct, it is possible to effect cleaning of outlet ducts 4, without this requiring disassembly of the valve, or removal of the entire valve arrangement. By means of open-ended passages 7, the outlet ducts 4 can be treated using simple cleaning tools.

The flow-through cross-section which is exposed by the recess in the valve head is preferably equal to about 50 to 70 percent of the cross-section of outlet ducts 4 in valve body 1. It is shown schematically in enlarged form in FIG. 3.

Since, when lead is used, oxide formation cannot be avoided and since these oxides rapidly deposit on the walls of outlet ducts 4, this arrangement makes it possible to nevertheless operate over long periods of time with high dosage accuracy.

As appears from the drawings and particularly from FIG. 3, the edges 8 of slots 6 in valve head 2 are preferably constructed with knife edges adjacent working surface 3. This produces a self cleaning effect on the sealing surface of the valve. This precaution also materially increases the time period during which the valve functions with high repeating precision, as compared with known valves. FIG. 5 shows the valve body 1 with the preferred conically shaped working surface 3. This configuration is especially suitable for self cleaning.

Valve body 2 can have imparted to it a rotary movement by various means not further illustrated in the drawings. For example, as shown in FIG. 6, a protrusion 10 can be attached to valve head 2 and this protrusion can then be placed in a notch 11 of a push rod 12 moving with reciprocatory motion.

The valve embodying the invention exhibits very low wear and, since it is free of after dripping, can advantageously be used in automatic production machinery. A further advantage is the possibility of servicing the valve during operation without disassembly. It is further characterized by high repeat precision and exact dosages, which is of fundamental importance particularly in an automatically operating system. The working surfaces themselves, can if appropriate, be further treated with a graphite-based heat resistant lubricant.

We claim:

1. A valve for metering doses of liquid from a reservoir comprising a valve body provided with a plurality of outlet ducts which are adapted to be positioned with their inlet openings below the surface of the liquid in the reservoir, a valve head having a plurality of recesses corresponding to the number of outlet ducts in the valve body and adapted to close said inlet openings, a plurality of open ended passages in the valve head, positioned for alignment with respective outlet ducts when the valve is closed, and means for rotating the valve head relative to the valve body to alternately align the recesses in the valve head and the open-ended passages with the outlet ducts, each recess being so dimensioned that, when it is aligned with the inlet opening, it frees a cross-sectional area which is smaller than the inlet opening, and the liquid being molten lead for the production of storage battery parts.

2. The valve of claim 1, wherein the recesses have the form of slots adjacent to the outlet ducts.

3. The valve of claim 1, wherein the slots have knife edges facing the outlet ducts.

4. The valve of claim 1 wherein the open-ended passages have substantially the same internal diameters as the outlet ducts.

5. The valve of claim 1, wherein the valve body and valve head have conically shaped mating surfaces.

6. The valve of claim 1 wherein the outlet duct openings are positioned substantially in the middle of the conical valve body surface.

7. The valve of claim 1, wherein the freed cross-sectional area of the inlets is between about 50 and 70 percent of the cross-sectional area of the ducts.

8. A valve for metering doses of liquid lead from a reservoir comprising:

a valve body having an upwardly tapering conical upper portion, and having a plurality of azimuthally separated outlet ducts extending from the surface of the conical portion to the opposite end of the body, a valve head having an internal hollow space conically shaped to seat on and mate with the conical portion of the body and rotatable relative to the conical body portion, the head being rotatable about the axis of the conical body portion, and having knife-edged recesses positioned for alignment with respective outlet ducts when the head is rotated into one azimuthal position, the recesses being so dimensioned as to free when aligned with the outlet ducts less than the entire cross-section of each duct, the head further having clean-out ducts extending from the internal hollow space to the opposite end of the head, the clean-out ducts being positioned at azimuthal positions different from those of the recesses but with the same separations as the outlet ducts, whereby the head can be rotated into a second azimuthal position about the axis of the conical body portion in which the recesses are out of alignment with the outlet ducts while the clean-out ducts are in alignment with the outlet ducts, so that the valve alternates between an open position, and a closed position in which latter the clean-out can take place through the aligned outlet and clean-out ducts.

9. The valve of claim 8 wherein the outlet and clean-out ducts are so shaped as to form a straight-through opening of uniform cross-section from top to bottom of the valve when in alignment.

* * * * *